US011193084B2

(12) United States Patent
Kubo et al.

(10) Patent No.: US 11,193,084 B2
(45) Date of Patent: Dec. 7, 2021

(54) LOW VISCOSITY LUBRICATING OIL COMPOSITIONS

(71) Applicant: Chevron Japan Ltd., San Ramon, CA (US)

(72) Inventors: Koichi Kubo, Yokohama (JP); Yoshitaka Takeuchi, Yoshida-Cho (JP); Taiki Hattori, Kakegawa (JP); Chihiro Sone, Makinohara (JP)

(73) Assignee: CHEVRON JAPAN LTD., Tokyo (JP)

( * ) Notice: Subject to any disclaimer, the term of this patent is extended or adjusted under 35 U.S.C. 154(b) by 16 days.

(21) Appl. No.: 16/193,440

(22) Filed: Nov. 16, 2018

(65) Prior Publication Data

US 2020/0157460 A1 May 21, 2020

(51) Int. Cl.

| | |
|---|---|
| ***C10M 169/04*** | (2006.01) |
| ***C10M 129/54*** | (2006.01) |
| ***C10M 139/00*** | (2006.01) |
| ***C10M 135/18*** | (2006.01) |
| ***C10M 141/12*** | (2006.01) |
| ***C10M 145/14*** | (2006.01) |
| ***C10M 161/00*** | (2006.01) |
| ***C10M 125/26*** | (2006.01) |
| ***C10M 129/50*** | (2006.01) |
| ***C10M 133/12*** | (2006.01) |
| ***C10M 133/44*** | (2006.01) |
| ***C10M 135/10*** | (2006.01) |
| ***C10M 137/10*** | (2006.01) |
| ***C10M 141/10*** | (2006.01) |
| *C10N 30/00* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 40/25* | (2006.01) |

(52) U.S. Cl.

CPC ..... *C10M 169/04* (2013.01); *C10M 125/26* (2013.01); *C10M 129/50* (2013.01); *C10M 129/54* (2013.01); *C10M 133/12* (2013.01); *C10M 133/44* (2013.01); *C10M 135/10* (2013.01); *C10M 137/10* (2013.01); *C10M 141/10* (2013.01); *C10M 2201/087* (2013.01); *C10M 2207/141* (2013.01); *C10M 2207/144* (2013.01); *C10M 2215/26* (2013.01); *C10M 2215/30* (2013.01); *C10M 2219/044* (2013.01); *C10M 2223/045* (2013.01); *C10N 2030/02* (2013.01); *C10N 2030/04* (2013.01); *C10N 2030/06* (2013.01); *C10N 2030/10* (2013.01); *C10N 2030/40* (2020.05); *C10N 2030/42* (2020.05); *C10N 2030/43* (2020.05); *C10N 2030/44* (2020.05); *C10N 2030/45* (2020.05); *C10N 2040/25* (2013.01)

(58) Field of Classification Search

CPC combination set(s) only.
See application file for complete search history.

(56) References Cited

U.S. PATENT DOCUMENTS

| | | | |
|---|---|---|---|
| 38,929 | A | 6/1863 | Hen-El et al. |
| 3,172,892 | A | 3/1965 | Le Suer et al. |
| 3,219,666 | A | 11/1965 | Norman et al. |
| 3,272,746 | A | 9/1966 | Le Suer et al. |
| 3,313,727 | A | 4/1967 | Peeler |
| 3,356,702 | A | 12/1967 | Farmer et al. |
| 3,819,521 | A | 6/1974 | Simsm |
| 3,853,772 | A | 12/1974 | Adams |
| 3,907,601 | A | 9/1975 | Ferdinand |
| 3,997,454 | A | 12/1976 | Adams |
| 4,089,790 | A | 5/1978 | Adams |
| 4,259,194 | A | 3/1981 | Devries et al. |
| 4,259,195 | A | 3/1981 | King et al. |
| 4,265,773 | A | 5/1981 | Devries et al. |
| 4,265,843 | A | 5/1981 | Dias et al. |
| 4,283,295 | A | 8/1981 | Devries et al. |
| 4,320,019 | A | 3/1982 | Hayashi |
| 4,727,387 | A | 2/1988 | Israely |
| 4,889,647 | A | 12/1989 | Rowan et al. |
| 5,888,945 | A | 3/1999 | Stiefel et al. |
| 6,174,842 | B1 | 1/2001 | Gatto et al. |
| 6,372,696 | B1 | 4/2002 | Tipton |
| 6,534,450 | B1 | 3/2003 | Harrison et al. |
| 6,737,387 | B2 | 5/2004 | Harrison et al. |

(Continued)

FOREIGN PATENT DOCUMENTS

| | | |
|---|---|---|
| EP | 1167497 A2 | 1/2002 |
| EP | 1918357 A2 | 5/2008 |
| EP | 2428551 A1 | 3/2012 |

OTHER PUBLICATIONS

International Search Report, dated Feb. 7, 2020, during the prosecution of International Application No. PCT/IB2019/059726.

(Continued)

*Primary Examiner* — Ellen M McAvoy
*Assistant Examiner* — Chantel L Graham

(57) ABSTRACT

Provided is a lubricating oil composition having a HTHS viscosity at 150° C. in a range of about 1.7 to about 3.2 mPa s and a low temperature cold cranking viscosity of less than 7,000 mPa s at −20° C., comprising: (a) a major amount of an oil of lubricating viscosity having a kinematic viscosity at 100° C. of from 3.5 $mm^2/s$ to 20 $mm^2/s$ and a viscosity index of greater than 120 with a sulfur content of less than 0.03 wt. %, are classified into the API group III, IV, or V base stock category, and have an aromatics content ($C_A$) of less than 5%; (b) an organomolybdenum compound; (c) a dispersed hydrated alkali metal borate compound; (e) one or more dispersants; (f) one or more calcium-based metal detergents; and (g) optionally, one or more magnesium-based metal detergents.

Also provided is a method for improving wear, high temperature detergency, and thermal stability in an engine comprising operating said engine with said lubricating oil composition.

24 Claims, No Drawings

(56) References Cited

U.S. PATENT DOCUMENTS

| | | | | |
|---|---|---|---|---|
| 6,806,241 | B2 | 10/2004 | Karol et al. | |
| 8,076,275 | B2 | 12/2011 | Ruhe, Jr. et al. | |
| 2011/0130317 | A1* | 6/2011 | Stevenson | C09D 11/326 508/547 |
| 2015/0045271 | A1* | 2/2015 | Yoshida | C10M 169/042 508/364 |
| 2015/0111797 | A1* | 4/2015 | Lyon | C10M 171/02 508/192 |
| 2015/0175927 | A1* | 6/2015 | Utaka | C10M 167/00 508/364 |
| 2015/0322369 | A1* | 11/2015 | Patel | C10M 163/00 508/162 |
| 2017/0121627 | A1* | 5/2017 | Ishikawa | C10M 129/50 |
| 2017/0158982 | A1* | 6/2017 | Tamura | C10M 163/00 |

OTHER PUBLICATIONS

Written Opinion of the International Searching Authority, dated Feb. 7, 2020, during the prosecution of International Application No. PCT/IB2019/059726.

* cited by examiner

LOW VISCOSITY LUBRICATING OIL COMPOSITIONS

BACKGROUND OF THE DISCLOSURE

Engine oil is usually blended with various additives in order to satisfy various performance requirements. One well known way to increase fuel economy is to decrease the viscosity of the lubricating oil. Most internal combustion engine oils, which demonstrate excellent fuel economy performance, are usually formulated to be low viscosity oils with a viscosity improver to reduce fluid friction from viscosity resistance under low temperature. In order to improve fuel efficiency, many original equipment manufacturers (OEM's) are looking at shifting to downsized turbo diesel (DE) and gasoline direct injection (GDI) engines for the improvement of fuel efficiency. The drawback to this is poor wear and engine durability, especially due to low viscosity with severe operating temperature and soot in oil conditions.

Further, to meet emission regulations, there is a need to reduce antiwear additive systems containing phosphorus, sulfur, and/or metals such as Zinc Dialkyldithiophosphate (ZnDTP). ZnDTP is a versatile anti-wear/anti-oxidant component that provides good wear and favorable oxidation protection under severe conditions. However, ZnDTPs comprise the elements zinc, sulfur and phosphorus which all have negative impact on exhaust after-treatment devices.

The inventors have discovered lubricating oil compositions which have good fuel efficiency and anti-wear properties with low SAE viscosity grade oils, even when the level of ZnDTP is reduced, or free of zinc and phosphorus.

SUMMARY OF THE DISCLOSURE

The present disclosure generally relates to a lubricating oil composition a HTHS viscosity at 150° C. in a range of about 1.7 to about 3.2 mPa s and a low temperature cold cranking viscosity of less than 7,000 mPa s at −20° C., comprising:

(a) a major amount of an oil of lubricating viscosity having a kinematic viscosity at 100° C. of from 3.5 $mm^2/s$ to 20 $mm^2/s$ and a viscosity index of greater than 120 with a sulfur content of less than 0.03 wt. %, are classified into the API group III, IV, or V base stock category, and have an aromatics content ($C_A$) of less than 5%;

(b) an organomolybdenum compound providing greater than 0.0050 wt. % of molybdenum to the lubricating oil composition;

(c) a dispersed hydrated alkali metal borate compound providing greater than 0.0050 to about 0.060 wt. % of alkali metal to the lubricating oil composition;

(d) a sulfur phosphorus anti-wear compound providing the lubricating oil composition with from 0 to about 0.06 wt. % of phosphorus;

(e) one or more dispersants providing the lubricating oil composition with greater than 0.0050 to about 0.040 wt. % of nitrogen; and (f) one or more calcium-based metal detergents selected from salicylate, sulfonate, and phenate;

(g) optionally, one or more magnesium-based metal detergents selected from salicylate, sulfonate, and phenate; and wherein the lubricating oil composition has a calcium content of from about 0.14 to about 0.30 wt. %, when present a magnesium content of from about 0.0005 to about 0.060 wt. %, a total nitrogen amount of from 0.0050 to about 0.090 wt. %, sulfur content of less than 0.13 wt. % and a sulfated ash level of from about 0.6 to about 1.1 wt. %.

Also provided are methods for improving wear, high temperature detergency, and thermal stability in an engine comprising operating said engine with a lubricating oil composition having a HTHS viscosity at 150° C. in a range of about 1.7 to about 3.2 mPa s and a low temperature cold cranking viscosity of less than 7,000 mPa s at −20° C., comprising:

(a) a major amount of an oil of lubricating viscosity having a kinematic viscosity at 100° C. of from 3.5 $mm^2/s$ to 20 $mm^2/s$ and a viscosity index of greater than 120 with a sulfur content of less than 0.03 wt. %, are classified into the API group III, IV, or V base stock category, and have an aromatics content ($C_A$) of less than 5%;

(b) an organomolybdenum compound providing greater than 0.0050 wt. % of molybdenum to the lubricating oil composition;

(c) a dispersed hydrated alkali metal borate compound providing greater than 0.0050 to about 0.060 wt. % of alkali metal to the lubricating oil composition;

(d) a sulfur phosphorus anti-wear compound providing the lubricating oil composition with from 0 to about 0.06 wt. % of phosphorus;

(e) one or more dispersants providing the lubricating oil composition with greater than 0.0050 to about 0.040 wt. % of nitrogen; and (f) one or more calcium-based metal detergents selected from salicylate, sulfonate, and phenate;

(g) optionally, one or more magnesium-based metal detergents selected from salicylate, sulfonate, and phenate; and wherein the lubricating oil composition has a calcium content of from about 0.14 to about 0.30 wt. %, when present a magnesium content of from about 0.0005 to about 0.060 wt. %, a total nitrogen amount of from 0.0050 to about 0.090 wt. %, sulfur content of less than 0.13 wt. % and a sulfated ash level of from about 0.6 to about 1.1 wt. %.

DETAILED DESCRIPTION OF THE DISCLOSURE

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

In this specification, the following words and expressions, if and when used, have the meanings given below.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" refers to additive material that is not diluent or solvent.

All percentages reported are weight % on an active ingredient basis (i.e., without regard to carrier or diluent oil) unless otherwise stated.

The abbreviation "ppm" means parts per million by weight, based on the total weight of the lubricating oil composition.

High temperature high shear (HTHS) viscosity at 150° C. was determined in accordance with ASTM D4683.

Kinematic viscosity at 100° C. ($KV_{100}$) was determined in accordance with ASTM D445.

Metal—The term "metal" refers to alkali metals, alkaline earth metals, or mixtures thereof.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The term "sulfated ash" as used herein refers to the non-combustible residue resulting from detergents and metallic additives in lubricating oil. Sulfated ash may be determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test.

Boron, calcium, magnesium, molybdenum, phosphorus, sulfur, and zinc contents were determined in accordance with ASTM D5185.

All ASTM standards referred to herein are the most current versions as of the filing date of the present application.

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

Note that not all of the activities described in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described herein with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or other features that are inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the embodiments of the disclosure. This description should be read to include one or at least one and the singular also includes the plural, or vice versa, unless it is clear that it is meant otherwise. The term "averaged," when referring to a value, is intended to mean an average, a geometric mean, or a median value. Group numbers corresponding to columns within the Periodic Table of the elements use the "New Notation" convention as seen in the CRC Handbook of Chemistry and Physics, 81st Edition (2000-2001).

Unless otherwise defined, all technical and scientific terms used herein have the same meaning as commonly understood by one of ordinary skill in the art to which this disclosure belongs. The materials, methods, and examples are illustrative only and not intended to be limiting. To the extent not described herein, many details regarding specific materials and processing acts are conventional and may be found in textbooks and other sources within the lubricants as well as the oil and gas industries.

The specification and illustrations are not intended to serve as an exhaustive and comprehensive description of all the elements and features of formulations, compositions, apparatus and systems that use the structures or methods described herein. Separate embodiments may also be provided in combination in a single embodiment, and conversely, various features that are, for brevity, described in the context of a single embodiment, may also be provided separately or in any sub-combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

In one aspect, the disclosure provides a lubricating oil composition having a HTHS viscosity at 150° C. in a range of about 1.7 to about 3.7 mPa s and a low temperature cold cranking viscosity of less than 7,000 mPa s at −20° C., comprising:

(a) a major amount of an oil of lubricating viscosity having a kinematic viscosity at 100° C. of from 3.5 $mm^2/s$ to 20 $mm^2/s$ and a viscosity index of greater than 120 and are classified into the API group III, IV or V base stock category;

(b) an organomolybdenum compound providing greater than 0.0050 wt. % of molybdenum to the lubricating oil composition;

(c) a dispersed hydrated alkali metal borate compound providing greater than 0.0050 wt. % of boron to the lubricating oil composition;

(d) a sulfur phosphorus anti-wear compound providing the lubricating oil composition with from 0 to about 0.06 wt. % of phosphorus;

(e) one or more dispersants providing the lubricating oil composition with greater than 0.008 wt. % of nitrogen; and (f) one or more calcium-based metal detergents selected from salicylate, sulfonate, and phenate;

(g) optionally, one or more magnesium-based metal detergents selected from salicylate, sulfonate, and phenate; and wherein the lubricating oil composition has a calcium content of from about 0.12 wt. % to about 0.30 wt. %, when present a magnesium content of from about 0.0005 wt. % to about 0.060 wt. %, sulfur content of less than 0.3 wt. % and a sulfated ash level of from about 0.6 to about 1.1 wt. %.

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(l-hexenes), poly(l-octenes), poly(l-decenes); alkylbenzenes (e.g., dodecylbenzenes, tetradecylbenzenes, dinonylbenzenes, di(2-ethylhexyl)benzenes, Alkylated Naphthalene; polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturate[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

In one embodiment, the base oils suitable for use herein are API Group Group III, Group IV, and Group V oils, and combinations thereof, due to their exceptional volatility, stability, viscometric and cleanliness features.

In another embodiment, the base oil has an aromatics content ($C_A$) of less than 5%. In other embodiments, the base oil has an aromatics content ($C_A$) of less than 4%, less than 3%, less than 2%, less than 1%. The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The topology of viscosity modifier could include, but is not limited to, linear, branched, hyperbranched, star, or comb topology.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-30, 0W-40, 5W, 5W-16, 5W-20, 5W-30, 5W-40, 10W, 10W-20, 10W-30, 10W-40, 15W, 15W-20, 15W-30, 15W-40 and the like.

Preferably, the base oil has a viscosity index of greater than 120 (e.g., greater than 125, greater than 130, greater than 135 or greater than 140). If the viscosity index is less than 120, not only viscosity-temperature properties, heat and oxidation stability, and anti-volatilization are reduced, but also the coefficient of friction tends to be increased, and resistance against wear tends to be reduced.

Preferably, a sulfur content of the base oil is equal to or less than 0.03 wt. % (e.g. less than 0.02 wt. %, less than 0.01 wt. % or less than 0.005 wt. %. If the sulfur content is higher than 0.03 wt. %, not only thermal and oxidation stability are reduced, but also corrosion to non-ferrous metals, ex. Cu and its alloys at higher temperature become stronger.

The lubricating oil composition has a viscosity index of at least 135 (e.g., 135 to 400, or 135 to 250), at least 150 (e.g., 150 to 400, 150 to 250), at least 160 (e.g., 160 to 400, or 160 to 250).—If the viscosity index of the lubricating oil composition is less than 135, it may be difficult to improve fuel efficiency while maintaining the HTHS viscosity at 150° C. If the viscosity index of the lubricating oil composition exceeds 400, evaporation properties may be reduced, and deficits due to insufficient solubility of the additive and matching properties with a seal material may be caused.

The lubricating oil composition has a high temperature shear (HTHS) viscosity at 150° C. of about 1.7 to about 3.2 mPa s, about 2.0 to 3.1 mPa a, about 2.0 to about 3.0, or about 2.0 to about 2.9.

The lubricating oil composition has a kinematic viscosity at 100° C. in a range of 3.5 to 20 $mm^2/s$ (e.g., 3.5 to 20 $mm^2/s$, 3.8 to 20 $mm^2/s$, 3.8 to 16.3 $mm^2/s$, 4 to 12.5 $mm^2/s$ or 4 to 9.3 $mm^2/s$).

The lubricating oil composition has a low temperature cold cranking viscosity of less than 7000 mPa s at −20° C. (e.g. less than 7000 mPa s at −25° C., less than 6600 mPa s at −30° C. or less than 6200 mPa s at −35° C.).

The Molybdenum Containing Compound

The organomolybdenum compound contains at least molybdenum, carbon and hydrogen atoms, but may also contain sulfur, phosphorus, nitrogen and/or oxygen atoms. Suitable organomolybdenum compounds include molybdenum dithiocarbamates, molybdenum dithiophosphates, and various organic molybdenum complexes such as molybdenum carboxylates, molybdenum esters, molybdenum amines, molybdenum amides, which can be obtained by reacting molybdenum oxide or ammonium molybdates with fats, glycerides or fatty acids, or fatty acid derivatives (e.g., esters, amines, amides). The term "fatty" means a carbon chain having 10 to 22 carbon atoms, typically a straight carbon chain.

Molybdate esters can be prepared by methods disclosed in U.S. Pat. Nos. 4,889,647 and 6,806,241B2. A commercial example is MOLYVAN® 855 additive, which is manufactured by R. T. Vanderbilt Company, Inc.

Molybdenum dithiocarbamate (MoDTC) is an organomolybdenum compound represented by the following structure (I):

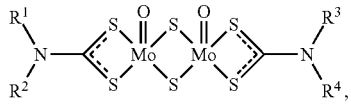

(I)

wherein $R^1$, $R^2$, $R^3$ and $R^4$ are independently of each other, linear or branched alkyl groups having from 4 to 18 carbon atoms (e.g., 8 to 13 carbon atoms).

Preparations of these compounds are well known in the literature and U.S. Pat. Nos. 3,356,702 and 4,098,705 are incorporated herein for reference. Commercial examples include MOLYVAN® 807, MOLYVAN® 822, and MOLYVAN® 2000, which are manufactured by R. T. Vanderbilt Company Inc., SAKURA-LUBE® 165 and SAKURA-LUBE® 515, which are manufactured by ADEKA CORPORATION and Naugalube® MolyFM which is manufactured by Chemtura Corporation.

Trinulcear molybdenum dialkyldithiocarbamates are also known in the art, as taught by U.S. Pat. Nos. 5,888,945 and 6,010,987, herein incorporated by reference. Trinuclear molybdenum compounds preferably those having the formulas $Mo_3S_4(dtc)_4$ and $Mo_3S_7(dtc)_4$ and mixtures thereof wherein dtc represents independently selected diorganodithiocarbamate ligands containing independently selected organo groups and wherein the ligands have a sufficient number of carbon atoms among all the organo groups of the compound's ligands are present to render the compound soluble or dispersible in the lubricating oil.

Molybdenum dithiophosphate (MoDTP) is an organomolybdenum compound represented by the following structure (II):

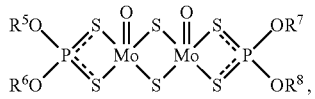

(II)

wherein $R^5$, $R^6$, $R^7$ and $R^8$ are independently of each other, linear or branched alkyl groups having from 4 to 18 carbon atoms (e.g., 8 to 13 carbon atoms).

Molybdenum carboxylates are described in U.S. No. Pat. RE 38,929, and U.S. Pat. No. 6,174,842 and thus are incorporated herein by reference. Molybdenum carboxylates can be derived from any oil soluble carboxylic acid. Typical carboxylic acids include naphthenic acid, 2-ethylhexanoic acid, and linolenic acid. Commercial sources of carboxylates produce from these particular acids are MOLYBDENUM NAP-ALL, MOLYBDENUM HEX-CEM, and MOLYBDENUM LIN-ALL respectively. Manufacturer of these products is OMG OM Group.

Ammonium molybdates are prepared by the acidibase reaction of acidic molybdenum source such as molybdenum trioxide, molybdic acid, and ammonium molybdate and ammonium thiomolybdates with oil-soluble amines and optionally in presence of sulfur sources such sulfur, inorganic sulfides and polysulfides, and carbons disulfide to name few. The preferred aminic compounds are polyamine dispersants that are commonly used engine oil compositions. Examples of such dispersants are succinimides and Mannich type. References to these preparations are U.S. Pat. Nos. 4,259,194, 4,259,195, 4,265,773, 4,265,843, 4,727,387, 4,283,295, and 4,285,822.

In one embodiment, the molybdenum amine is a molybdenum-succinimide complex. Suitable molybdenum-succinimide complexes are described, for example, in U.S. Pat. No. 8,076,275. These complexes are prepared by a process comprising reacting an acidic molybdenum compound with an alkyl or alkenyl succinimide of a polyamine of structure (III) or (IV) or mixtures thereof:

(III)

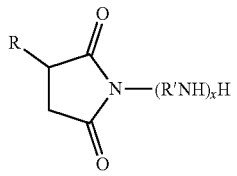

and (IV)

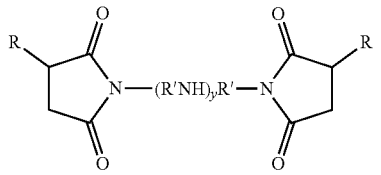

wherein R is a $C_{24}$ to $C_{350}$ (e.g., $C_{70}$ to $C_{128}$) alkyl or alkenyl group; R' is a straight or branched-chain alkylene group having 2 to 3 carbon atoms; x is 1 to 11; and y is 1 to 10.

The molybdenum compounds used to prepare the molybdenum-succinimide complex are acidic molybdenum compounds or salts of acidic molybdenum compounds. By "acidic" is meant that the molybdenum compounds will react with a basic nitrogen compound as measured by ASTM D664 or D2896. Generally, the acidic molybdenum compounds are hexavalent. Representative examples of suitable molybdenum compounds include molybdenum trioxide, molybdic acid, ammonium molybdate, sodium molybdate, potassium molybdate and other alkaline metal molybdates and other molybdenum salts such as hydrogen salts, (e.g., hydrogen sodium molybdate), $MoOCl_4$, $MoO_2Br_2$, $Mo_2O_3Cl_6$, and the like.

The succinimides that can be used to prepare the molybdenum-succinimide complex are disclosed in numerous references and are well known in the art. Certain fundamental types of succinimides and the related materials encompassed by the term of art "succinimide" are taught in U.S. Pat. Nos. 3,172,892; 3,219,666; and 3,272,746. The term "succinimide" is understood in the art to include many of the amide, imide, and amidine species which may also be formed. The predominant product however is a succinimide and this term has been generally accepted as meaning the product of a reaction of an alkyl or alkenyl substituted succinic acid or anhydride with a nitrogen-containing compound. Preferred succinimides are those prepared by reacting a polyisobutenyl succinic anhydride of about 70 to 128 carbon atoms with a polyalkylene polyamine selected from triethylenetetramine, tetraethylenepentamine, and mixtures thereof.

The molybdenum-succinimide complex may be post-treated with a sulfur source at a suitable pressure and a temperature not to exceed 120° C. to provide a sulfurized molybdenum-succinimide complex. The sulfurization step may be carried out for a period of from about 0.5 to 5 hours (e.g., 0.5 to 2 hours). Suitable sources of sulfur include elemental sulfur, hydrogen sulfide, phosphorus pentasulfide, organic polysulfides of formula $R_2S_x$ where R is hydrocarbyl (e.g., $C_1$ to $C_{10}$ alkyl) and x is at least 3, $C_1$ to $C_{10}$ mercaptans, inorganic sulfides and polysulfides, thioacetamide, and thiourea.

The lubricating oil compositions of the present invention will contain at least about 0.0050 wt. %, at least about 0.0060 wt. %, at least about 0.0070 wt. %, at least about 0.080 wt. %, at least about 0.0090 wt. %, at least about 0.010 wt. %, at least about 0.011 wt. % of molybdenum, based upon the total mass of the composition, provided from the one or more oil-soluble or dispersed oil-stable molybdenum-containing compounds. In one embodiment, the lubricating oil compositions of the present invention will contain about 0.0050 wt. % to about 0.10 wt. %, about 0.0050 wt. % to about 0.050 wt. %, about 0.0050 wt. % to about 0.040 wt. %, about 0.0060 wt. % to about 0.030 wt. %, about 0.0080 wt. % to about 0.020 wt. %, about 0.010 wt. % to about 0.018 wt. % of molybdenum, based on the total mass of the composition provided from the one or more oil-soluble or dispersed oil-stable molybdenum-containing compounds.

The Dispersed Alkali Metal Borate Compound

The hydrated particulate alkali metal borates are well known in the art and are available commercially. Representative examples of hydrated particulate alkali metal borates and methods of manufacture include those disclosed in, e.g., U.S. Pat. Nos. 3,313,727; 3,819,521; 3,853,772; 3,907,601; 3,997,454; 4,089,790; 6,737,387 and 6,534,450, the contents of which are incorporated herein by reference. The hydrated alkali metal borates can be represented by the following Formula: $M_2O.mB_2O_3.nH_2O$ where M is an alkali metal of atomic number in the range of about 11 to about 19, e.g., sodium and potassium; m is a number from about 2.5 to about 4.5 (both whole and fractional); and n is a number from about 1.0 to about 4.8. The hydrated borate particles generally have a mean particle size of less than about 1 micron.

The lubricating oil compositions of the present invention will contain greater than about 50 ppm of boron, based upon the total mass of the composition, provided from the one or more alkali metal borate compounds. In one embodiment, the lubricating oil compositions of the present invention will contain at least about 0.0060 wt. % of boron, based upon the total mass of the composition, provided from the one or more alkali metal borate compounds. In another embodiment, the lubricating oil compositions of the present invention will contain at least about 0.0070 wt. % of boron, based upon the total mass of the composition, provided from the one or more alkali metal borate compounds. In yet another embodiment, the lubricating oil compositions of the present invention will contain at least about 0.0080 wt. % of boron, based upon the total mass of the composition, provided from the one or more alkali metal borate compounds. In yet another embodiment, the lubricating oil compositions of the present invention will contain at least about 0.010 wt. % of boron, based upon the total mass of the composition, provided from the one or more alkali metal borate compounds. In yet another embodiment, the lubricating oil compositions of the present invention will contain at least about 0.0080 wt. % of boron, based upon the total mass of the composition, provided from the one or more alkali metal borate compounds. In other embodiments, the lubricating oil compositions of the present invention will contain from about 0.0050 wt. % to no more than about 0.20 wt. %, about 0.0050 wt.

% to no more than about 0.15 wt. %, about 0.0050 wt. % to no more than about 0.10 wt. % about 0.0050 wt. % to no more than about 0.060 wt. %, about 0.010 wt. % to no more than about 0.15 wt. %, about 0.010 wt. % to no more than about 0.12 wt. %, about 0.010 wt. % to no more than about 0.10 wt. %, about 0.010 wt. % to no more than about 0.060 wt. %, based upon the total mass of the composition, provided from the one or more alkali metal borate compounds.

In one aspect of this disclosure, the alkali metal borates employed in this invention provides from 0.0050 to 0.060 wt. % of alkali metal to the lubricating oil composition. In other embodiments, the lubricating oil compositions of the present invention will contain from about 0.0050 wt. % to no more than about 0.050 wt. %, about 0.010 wt. % to no more than about 0.050 wt. %, about 0.010 wt. % to no more than 0.040 wt. %, about 0.010 wt. % to no more than 0.030 wt. %, based upon the total mass of the composition, provided from the one or more alkali metal borated compounds.

In one aspect of this disclosure, the alkali metal borates employed in this invention are present at ratios of boron to alkali metal in the range from about 2.5:1 to about 4.5:1.

Oil dispersions of hydrated alkali metal borates are generally prepared by forming, in deionized water, a solution of alkali metal hydroxide and boric acid, optionally in the presence of a small amount of the corresponding alkali metal carbonate. The solution is then added to a lubricant composition comprising an oil of lubricating viscosity, a dispersant and any additives to be included therein (e.g., a detergent, or other optional additives) to form an emulsion that is then dehydrated.

Because of their retention of hydroxyl groups on the borate complex, these complexes are referred to as "hydrated alkali metal borates" and compositions containing oil/water emulsions of these hydrated alkali metal borates are referred to as "oil dispersions of hydrated alkali metal borates".

In another aspect of this disclosure, the hydrated alkali metal borate particles generally will have a mean particle size of less than 1 micron. In this regard, it has been found that the hydrated alkali metal borates employed in this invention preferably will have a particle size where 90% or greater of the particles are less than 0.6 microns.

In the oil dispersion of hydrated alkali metal borate, the hydrated alkali metal borate will generally comprise about 10 to 75 weight percent, preferably 25 to 50 weight percent, more preferably about 30 to 40 weight percent of the total weight of the oil dispersion of the hydrated borate. (Unless otherwise stated, all percentages are in weight percent.) This composition or concentrate is employed, often in the form of an additive package, to form the finished lubricant composition. Sufficient amounts of the concentrate are added so that the finished lubricant composition preferably comprises from about 0.2 to about 5 weight percent of the total weight of the lubricant composition and, even more preferably, from about 0.5 to 2 weight percent.

The lubricating oil compositions of the present invention will contain greater than about 0.0050 wt. % of boron, based upon the total mass of the composition, provided from the one or more alkali metal borates. In some embodiments, the lubricating oil compositions of the present invention will contain from about 0.0050 wt. % to about 0.050 wt. %, about 0.0050 wt. % to about 0.040 wt. %, about 0.0050 wt. % to about 0.030 wt. %, about 0.0075 wt. % to about 0.025 wt. % of boron, based upon the total mass of the composition, provided from the one or more alkali metal borates.

Sulfur Phosphorus Anti-Wear Compound

In one embodiment, the sulfur phosphorus anti-wear compound is zinc dihydrocarbyl dithiophosphate (ZDDP).

Antiwear agents reduce wear of metal parts. Suitable anti-wear agents include dihydrocarbyl dithiophosphate metal salts such as zinc dihydrocarbyl dithiophosphates (ZDDP) of formula (V):

$$Zn[S—P(=S)(OR^1)(OR^2)]_2 \quad (V)$$

wherein $R^1$ and $R^2$ may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as $R^1$ and $R^2$ groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e., $R^1+R^2$) will be at least 5. The zinc dihydrocarbyl dithiophosphate can therefore comprise zinc dialkyl dithiophosphates. The zinc dialkyl dithiophosphate can be a primary or secondary zinc dialkyl dithiophosphate.

ZDDP may be present at 3 wt. % or less (e.g., 0.1 to 1.5 wt. %, or 0.5 to 1.0 wt. %) of the lubricating oil composition.

In some embodiments, ZDDP provides from 0 to 0.06 wt. % phosphorus to the lubricating oil composition. In other embodiments, ZDDP provides from 0 to 0.05 wt. %, from 0 to 0.04 wt. %, from 0 to 0.03 wt. %, from 0 to 0.02 wt. %, from 0 to 0.01 wt. %, from 0 to 0.009, from 0 to 0.006, from 0 to 0.004, from 0 to 0.002, wt. %, 0 wt. % phosphorus to the lubricating oil composition.

In some embodiments, ZDDP provides from 0 to 0.12 wt. % sulfur to the lubricating oil composition, based on the weight of the lubricating oil composition. In other embodiments, ZDDP provides from 0 to 0.10 wt. %, from 0 to 0.08 wt. %, from 0 to 0.06 wt. %, from 0 to 0.04 wt. %, from 0 to 0.02 wt. %, from 0 to 0.018, from 0 to 0.012, from 0 to 0.008, from 0 to 0.004, wt. %, 0 wt. % sulfur to the lubricating oil composition, based on the weight of the lubricating oil composition.

Nitrogen Containing Dispersant

Dispersants maintain in suspension materials resulting from oxidation during engine operation that are insoluble in oil, thus preventing sludge flocculation and precipitation or deposition on metal parts. Dispersants useful herein include nitrogen-containing, ashless (metal-free) dispersants known to effective to reduce formation of deposits upon use in gasoline and diesel engines.

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also suitable are condensation products of polyamines and hydrocarbyl-substituted phenyl acids. Mixtures of these dispersants can also be used.

Basic nitrogen-containing ashless dispersants are well-known lubricating oil additives and methods for their preparation are extensively described in the patent literature. Preferred dispersants are the alkenyl succinimides and succinamides where the alkenyl-substituent is a long-chain of preferably greater than 40 carbon atoms. These materials are readily made by reacting a hydrocarbyl-substituted dicarboxylic acid material with a molecule containing amine functionality. Examples of suitable amines are polyamines such as polyalkylene polyamines, hydroxy-substituted polyamines and polyoxyalkylene polyamines.

Particularly preferred ashless dispersants are the polyisobutenyl succinimides formed from polyisobutenyl succinic anhydride and a polyalkylene polyamine such as a polyethylene polyamine of formula:

$$NH_2(CH_2CH_2NH)_zH$$

wherein z is 1 to 11. The polyisobutenyl group is derived from polyisobutene and preferably has a number average molecular weight ($M_n$) in a range of 700 to 3000 Daltons (e.g., 900 to 2500 Daltons). For example, the polyisobutenyl succinimide may be a bis-succinimide derived from a polyisobutenyl group having a $M_n$ of 900 to 2500 Daltons.

As is known in the art, the dispersants may be post-treated (e.g., with a boronating agent or a cyclic carbonate).

Nitrogen-containing ashless (metal-free) dispersants are basic, and contribute to the TBN of a lubricating oil composition to which they are added, without introducing additional sulfated ash.

Dispersants may be present at 0.1 to 10 wt. % (e.g., 2 to 5, wt. %) of the lubricating oil composition.

Nitrogen from the dispersants is present from greater than 0.0050 to 0.30 wt. % (e.g., greater than 0.0050 to 0.10 wt. %, 0.0050 to 0.080 wt. %, 0.0050 to 0.060 wt. %, 0.0050 to 0.050 wt. %, 0.0050 to 0.040 wt. %, 0.0050 to 0.030 wt. %,) based on the weight of the dispersants in the finished oil.

Detergents

The lubricating oil composition of the present invention can further contain one or more detergents.

Detergents that may be used include oil-soluble overbased sulfonate, non-sulfur containing phenate, sulfurized phenates, salixarate, salicylate, saligenin, complex detergents and naphthenate detergents and other oil-soluble alkylhydroxybenzoates of a metal, particularly the alkali or alkaline earth metals, e.g., barium, sodium, potassium, lithium, calcium, and magnesium. The most commonly used metals are calcium and magnesium, which may present separately or in combination in detergents used in a lubricant.

In some embodiments, the detergent is a calcium detergent. In one embodiment, the calcium-containing detergent may be used in an amount that provides from 0.14 to 0.30 wt. % calcium to the lubricating oil composition. In other embodiment, the calcium-containing detergent may be used in an amount that provides from 0.15 to 0.28 wt. % calcium to the lubricating oil composition.

In other embodiments, the detergent is a magnesium detergent. In one embodiment, the magnesium-containing detergent may be used in an amount that provides from 0.0005 to 0.060 wt. % magnesium to the lubricating oil composition. In some embodiments, the magnesium-containing detergent may be used in an amount that provides from 0.0005 to 0.050, 0.001 to 0.050, 0.001 to 0.040 wt. % magnesium to the lubricating oil composition.

Overbased metal detergents are generally produced by carbonating a mixture of hydrocarbons, detergent acid, for example: sulfonic acid, alkylhydroxybenzoate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Overbased detergents may be low overbased, e.g., an overbased salt having a TBN below 100 on an actives basis. In one embodiment, the TBN of a low overbased salt may be from about 30 to about 100. In another embodiment, the TBN of a low overbased salt may be from about 30 to about 80. Overbased detergents may be medium overbased, e.g., an overbased salt having a TBN from about 100 to about 250. In one embodiment, the TBN of a medium overbased salt may be from about 100 to about 200. In another embodiment, the TBN of a medium overbased salt may be from about 125 to about 175. Overbased detergents may be high overbased, e.g., an overbased salt having a TBN above 250. In one embodiment, the TBN of a high overbased salt may be from about 250 to about 800 on an actives basis.

Generally, the amount of the detergent can be from about 0.001 wt. % to about 50 wt. %, or from about 0.05 wt. % to about 25 wt. %, or from about 0.1 wt. % to about 20 wt. %, or from about 0.01 to 15 wt. % based on the total weight of the lubricating oil composition.

In general, the level of sulfur in the lubricating oil compositions of the present invention is less than or equal to about 0.30 wt., based on the total weight of the lubricating oil composition, e.g., a level of sulfur of about 0.01 to about 0.30 wt. %, about 0.01 to about 0.25 wt. %, about 0.01 to about 0.24 wt. %, about 0.01 to about 0.23 wt. %, about 0.01 to about 0.22 wt. %, about 0.01 to about 0.21 wt. %, about 0.01 to about 0.20 wt. %, about 0.01 to about 0.19 wt. %, about 0.01 to about 0.18 wt. %, about 0.01 to about 0.17 wt. %, about 0.01 to about 0.16 wt. %, of sulfur based on the total weight of the lubricating oil composition.

In some embodiments, the lubricating oil compositions of the present invention are substantially free of any phosphorus content. In some embodiments, the level of phosphorous in the lubricating oil compositions of the present invention is from about 0.005 wt. % to about 0.06 wt. %, 0.010 wt. % to about 0.06 wt. %, 0.010 wt. % to about 0.055 wt. %, 0.010 wt. % to about 0.05 wt. %, 0.010 wt. % to about 0.05 wt. %, 0.010 wt. % to about 0.045 wt. %, 0.010 wt. % to about 0.04 wt. %, 0.010 wt. % to about 0.035 wt. %, 0.010 wt. % to about 0.03 wt. %, based on the total weight of the lubricating oil composition. In one embodiment, the lubricating oil compositions of the present invention are substantially free of any zinc dialkyl dithiophosphate.

In one embodiment, the level of sulfated ash produced by the lubricating oil compositions of the present invention is less than or equal to about 1.1 wt. % as determined by ASTM D 874, e.g., a level of sulfated ash of from about 0.6 to about 1.1 wt. % as determined by ASTM D 874. In one embodiment, the level of sulfated ash produced by the lubricating oil compositions of the present invention is less than or equal to about 1.0 wt. % as determined by ASTM D 874, e.g., a level of sulfated ash of from about 0.6 to about 1.0 wt. % as determined by ASTM D 874. In one embodiment, the level of sulfated ash produced by the lubricating oil compositions of the present invention is less than or equal to about 0.9 wt. % as determined by ASTM D 874, e.g., a level of sulfated ash of from about 0.6 to about 0.9 wt. % as determined by ASTM D 874, based on the total weight of the lubricating oil composition.

Other Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, additional metal detergents, rust inhibitors, dehazing agents, demulsifying agents, metal deactivating agents, friction modifiers, pour point depressants, antifoaming agents, co-solvents, corrosion-inhibitors, additional ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

Friction Modifiers

The lubricating oil composition of the present invention can contain one or more friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition.

Antioxidants

Antioxidants reduce the tendency of mineral oils during to deteriorate during service. Oxidative deterioration can be evidenced by sludge in the lubricant, varnish-like deposits on the metal surfaces, and by viscosity growth. Suitable antioxidants include hindered phenols, aromatic amines, and sulfurized alkylphenols and alkali and alkaline earth metals salts thereof.

Examples of the hindered phenol oxidation inhibitors include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thio-diethylenebis[3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate, and octyl 3-(3,54-butyl-4-hydroxy-3-methylphenyl)propionate, and commercial products such as, but not limited to, Irganox L135® (BASF), Naugalube 531® (Chemtura), and Ethanox 376® (SI Group).

The lubricating oil compositions of the present invention can contain an amine antioxidant. In one embodiment, the antioxidant is a diphenylamine antioxidant. Examples of diphenyl amine antioxidants include monoalkylated diphenylamine, dialkylated diphenylamine, trialkylated diphenylamine, and mixtures thereof. Some of these include butyldiphenylamine, di-butyldiphenylamine, oxtyldiphenylamine, di-octyldiphenylamine, nonyldiphenylamine, di-nonyldiphenylamine, t-butyl-t-octyldiphenylamine, bis-nonylated diphenylamine, bis-octylated diphenylamine, and phenyl-α-naphthylamine, alkyl or arylalkyl substituted phenyl-α-naphthylamine, alkylated p-phenylene diamines, tetramethyl-diaminodiphenylamine and the like.

Antioxidants may be present at 0.01 to 5 wt. % (e.g., 0.1 to 2 wt. %) of the lubricating oil composition.

Corrosion Inhibitors

Corrosion inhibitors protect lubricated metal surfaces against chemical attack by water or other contaminants. Suitable corrosion inhibitors include polyoxyalkylene polyols and esters thereof, polyoxyalkylene phenols, thiadiazoles and anionic alkyl sulfonic acids. Such additives may be present at 0.01 to 5 wt. % (e.g., 0.1 to 1.5 wt. %) of the lubricating oil composition.

Foam Inhibitors

Foam control can be provided by many compounds including a foam inhibitor of the polysiloxane type (e.g., silicone oil or polydimethyl siloxane). Foam inhibitors may be present at less than 0.1 wt. % (e.g., 0.0001 to 0.01 wt. %) of the lubricating oil composition.

Pour Point Depressants

Pour point depressants lower the minimum temperature at which a fluid will flow or can be poured. Suitable pour point depressants include $C_8$ to $C_{18}$ dialkyl fumarate/vinyl acetate copolymers, polyalkylmethacrylates and the like. Such additives may be present at 0.01 to 5 wt. % (e.g., 0.1 to 1.5 wt. %) of the lubricating oil composition.

Viscosity Modifiers

The lubricating oil composition can further comprise a viscosity modifier.

Viscosity modifiers function to impart high and low temperature operability to a lubricating oil. The viscosity modifier used may have that sole function or may be multifunctional. Multifunctional viscosity modifiers that also function as dispersants are also known. Suitable viscosity modifiers include polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene. In one embodiment, the viscosity modifier is a polyalkylmethacrylate. The topology of the viscosity modifier could include, but is not limited to, linear, branched, hyperbranched, star, or comb topology. The viscosity modifier can be non-dispersant type or dispersant type. In one embodiment, the viscosity modifier is a dispersant polymethacrylate.

Suitable viscosity modifiers have a Permanent Shear Stability Index (PSSI) of 30 or less (e.g., 10 or less, 5 or less, or even 2 or less). PSSI is a measure of the irreversible decrease, resulting from shear, in an oil's viscosity contributed by an additive. PSSI is determined according to ASTM D6022. The lubricating oil compositions of the present disclosure display stay-in-grade capability. Retention of kinematic viscosity at 100° C. within a single SAE viscosity grade classification by a fresh oil and its sheared version is evidence of an oil's stay-in-grade capability.

The viscosity modifier may be used in an amount of from 0.5 to 15.0 wt. % (e.g., 0.5 to 10 wt. %, 0.5 to 5 wt. %, 1.0 to 15 wt. %, 1.0 to 10 wt. %, or 1.0 to 5 wt. %), based on the total weight of the lubricating oil composition.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

In the preparation of lubricating oil formulations, it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Processes of Preparing Lubricating Oil Compositions

The lubricating oil compositions disclosed herein can be prepared by any method known to a person of ordinary skill in the art for making lubricating oils. In some embodiments, the base oil can be blended or mixed with the additive compounds described herein. Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

In some embodiments, the lubricating oil composition disclosed herein may be suitable for use as motor oils (that is, engine oils or crankcase oils), in a compression ignited engine or in a spark-ignited internal combustion engine, particularly a direct injected, boosted, engine.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

Reference Example 1

A 10W-30 lubricating oil composition was prepared that contained a major amount of a base oil of lubricating viscosity and the following additives:

(1) an ethylene carbonate post-treated bis-succinimide and a borated bis-succinimide;
Total Nitrogen content from the dispersants in Example 1 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group I base oil.

Example 2

A 5W-30 lubricating oil composition was prepared that contained a major amount of a base oil of lubricating viscosity and the following additives:

(1) an ethylene carbonate post-treated bis-succinimide and a borated bis-succinimide;
Total Nitrogen content from the dispersants in Example 2 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 3

A 0W-30 lubricating oil composition was prepared that contained a major amount of a base oil of lubricating viscosity and the following additives:

(1) an ethylene carbonate post-treated bis-succinimide and a borated bis-succinimide;
Total Nitrogen content from the dispersants in Example 3 is 0.028 wt. %

(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 4

A 5W-20 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 4 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 5

A 0W-20 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 5 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 6

A 0W-20 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 6 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 7

A 0W-16 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 7 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 8

A 0W-16 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 8 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;

(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 9

A 0W-16 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 9 is 0.028 wt. %
(2) a mixture of calcium phenate, sulfonate and salicylate detergents in an amount to provide the calcium content provided in table 2;
(3) a magnesium sulfonate detergent in an amount to provide the magnesium content provided in table 2;
(4) a primary ZnDTP in an amount to provide the phosphorus content provided in table 2;
(5) a molybdenum succinimide antioxidant in an amount to provide the molybdenum content provided in table 2;
(6) a hydrated potassium borate dispersion in an amount to provide the potassium content provided in table 2;
(7) an alkylated diphenylamine;
(8) 5 ppm in terms of silicon content, of a foam inhibitor;
(9) an ethylene propylene viscosity modifier in an amount to give the proper viscosity grade; and
(10) a polymethacrylate PPD
(11) the remainder, a Group III base oil.

Example 10

A 5W-30 lubricating oil composition was prepared that contained a major amount of a base oil of lubricating viscosity and the following additives:
(1) an ethylene carbonate post-treated bis-succinimide and a borated bis-succinimide;
Total Nitrogen content from the dispersants in Example 10 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Example 11

A 5W-30 lubricating oil composition which was zinc and phosphorus free was prepared that contained a major amount of a base oil of lubricating viscosity and the following additives:
(1) an ethylene carbonate post-treated bis-succinimide and a borated bis-succinimide;
Total Nitrogen content from the dispersants in Example 11 is 0.028 wt. %
(2) a mixture of calcium phenate, sulfonate and salicylate detergents in an amount to provide the calcium content provided in table 2;
(3) a molybdenum succinimide antioxidant in an amount to provide the molybdenum content provided in table 2;
(4) a hydrated potassium borate dispersion in an amount to provide the potassium content provided in table 2;
(5) an alkylated diphenylamine;
(6) 5 ppm in terms of silicon content, of a foam inhibitor;
(7) an ethylene propylene viscosity modifier in an amount to give the proper viscosity grade; and
(8) a polymethacrylate PPD
(9) the remainder, a Group III base oil.

Example 12

A 0W-20 lubricating oil composition which was zinc and phosphorus free was prepared that contained a major amount of a base oil of lubricating viscosity and the following additives:
(1) an ethylene carbonate post-treated bis-succinimide and a borated bis-succinimide;
Total Nitrogen content from the dispersants in Example 12 is 0.028 wt. %
(2) a mixture of calcium phenate, sulfonate and salicylate detergents in an amount to provide the calcium content provided in table 2;
(3) a molybdenum succinimide antioxidant in an amount to provide the molybdenum content provided in table 2;
(4) a hydrated potassium borate dispersion in an amount to provide the potassium content provided in table 2;
(5) an alkylated diphenylamine;
(6) 5 ppm in terms of silicon content, of a foam inhibitor;
(7) an ethylene propylene viscosity modifier in an amount to give the proper viscosity grade; and
(8) a polymethacrylate PPD
(9) the remainder, a Group III base oil.

Example 13

A 0W-20 lubricating oil composition which was zinc and phosphorus free was prepared that contained a major amount of a base oil of lubricating viscosity and the following additives:
(1) an ethylene carbonate post-treated bis-succinimide and a borated bis-succinimide;
Total Nitrogen content from the dispersants in Example 13 is 0.028 wt. %
(2) a mixture of calcium phenate, sulfonate and salicylate detergents in an amount to provide the calcium content provided in table 2;
(3) a molybdenum succinimide antioxidant in an amount to provide the molybdenum content provided in table 2;
(4) a hydrated potassium borate dispersion in an amount to provide the potassium content provided in table 2;
(5) an alkylated diphenylamine;
(6) 5 ppm in terms of silicon content, of a foam inhibitor;
(7) an ethylene propylene viscosity modifier in an amount to give the proper viscosity grade; and
(8) a polymethacrylate PPD
(9) the remainder, a Group III base oil.

Example 14

A 0W-20 lubricating oil composition which was zinc and phosphorus free was prepared that contained a major amount of a base oil of lubricating viscosity and the following additives:

(1) an ethylene carbonate post-treated bis-succinimide and a borated bis-succinimide;
Total Nitrogen content from the dispersants in Example 14 is 0.028 wt. %
(2) a mixture of calcium phenate, sulfonate and salicylate detergents in an amount to provide the calcium content provided in table 2;
(3) a magnesium sulfonate detergent in an amount to provide the magnesium content provided in table 2;
(4) a molybdenum succinimide antioxidant in an amount to provide the molybdenum content provided in table 2;
(5) a hydrated potassium borate dispersion in an amount to provide the potassium content provided in table 2;
(6) an alkylated diphenylamine;
(7) 5 ppm in terms of silicon content, of a foam inhibitor;
(8) an ethylene propylene viscosity modifier in an amount to give the proper viscosity grade; and
(9) a polymethacrylate PPD
(10) the remainder, a Group III base oil.

Comparative Example 1

A 0W-16 lubricating oil composition was prepared that contained a major amount of a base oil of lubricating viscosity and the following additives:

(1) an ethylene carbonate post-treated bis-succinimide and a borated bis-succinimide;
Total Nitrogen content from the dispersants in Comparative Example 1 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) an alkylated diphenylamine;
(5) 5 ppm in terms of silicon content, of a foam inhibitor;
(6) an ethylene propylene viscosity modifier in an amount to give the proper viscosity grade; and
(7) a polymethacrylate PPD
(8) the remainder, a Group III base oil.

Comparative Example 2

A 0W-16 lubricating oil composition was prepared that contained a major amount of a base oil of lubricating viscosity and the following additives:

(1) an ethylene carbonate post-treated bis-succinimide and a borated bis-succinimide;
Total Nitrogen content from the dispersants in Comparative Example 2 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a molybdenum succinimide antioxidant in an amount to provide the molybdenum content provided in table 2;
(5) an alkylated diphenylamine;
(6) 5 ppm in terms of silicon content, of a foam inhibitor;
(7) an ethylene propylene viscosity modifier in an amount to give the proper viscosity grade; and
(8) a polymethacrylate PPD
(9) the remainder, a Group III base oil.

Comparative Example 3

A 0W-16 lubricating oil composition was prepared that contained a major amount of a base oil of lubricating viscosity and the following additives:

(1) an ethylene carbonate post-treated bis-succinimide and a borated bis-succinimide;
Total Nitrogen content from the dispersants in Comparative Example 3 is 0.028 wt. %
(2) a mixture of calcium phenate, sulfonate and salicylate detergents in an amount to provide the calcium content provided in table 2;
(3) a primary ZnDTP in an amount to provide the phosphorus content provided in table 2;
(4) a hydrated potassium borate dispersion in an amount to provide the potassium content provided in table 2;
(5) an alkylated diphenylamine;
(6) 5 ppm in terms of silicon content, of a foam inhibitor;
(7) an ethylene propylene viscosity modifier in an amount to give the proper viscosity grade; and
(8) a polymethacrylate PPD
(9) the remainder, a Group III base oil.

Comparative Example 4

A 5W-30 lubricating oil composition which was zinc and phosphorus free was prepared that contained a major amount of a base oil of lubricating viscosity and the following additives:

(1) an ethylene carbonate post-treated bis-succinimide and a borated bis-succinimide;
Total Nitrogen content from the dispersants in Comparative Example 4 is 0.028 wt. %
(2) a mixture of calcium phenate, sulfonate and salicylate detergents in an amount to provide the calcium content provided in table 2;
(3) an alkylated diphenylamine;
(4) 5 ppm in terms of silicon content, of a foam inhibitor;
(5) an ethylene propylene viscosity modifier in an amount to give the proper viscosity grade; and
(6) a polymethacrylate PPD
(7) the remainder, a Group III base oil.

Comparative Example 5

A 5W-30 lubricating oil composition which was zinc and phosphorus free was prepared that contained a major amount of a base oil of lubricating viscosity and the following additives:

(1) an ethylene carbonate post-treated bis-succinimide and a borated bis-succinimide;
Total Nitrogen content from the dispersants in Comparative Example 5 is 0.028 wt. %
(2) a mixture of calcium phenate, sulfonate and salicylate detergents in an amount to provide the calcium content provided in table 2;
(3) a molybdenum succinimide antioxidant in an amount to provide the molybdenum content provided in table 2;
(4) an alkylated diphenylamine;
(5) 5 ppm in terms of silicon content, of a foam inhibitor;
(6) an ethylene propylene viscosity modifier in an amount to give the proper viscosity grade; and
(7) a polymethacrylate PPD
(8) the remainder, a Group III base oil.

Comparative Example 6

A 5W-30 lubricating oil composition which was zinc and phosphorus free was prepared that contained a major amount of a base oil of lubricating viscosity and the following additives:

(1) an ethylene carbonate post-treated bis-succinimide and a borated bis-succinimide;
Total Nitrogen content from the dispersants in Comparative Example 6 is 0.028 wt. %
(2) a mixture of calcium phenate, sulfonate and salicylate detergents in an amount to provide the calcium content provided in table 2;
(3) a hydrated potassium borate dispersion in an amount to provide the potassium content provided in table 2;
(4) an alkylated diphenylamine;
(5) 5 ppm in terms of silicon content, of a foam inhibitor;
(6) an ethylene propylene viscosity modifier in an amount to give the proper viscosity grade; and
(7) a polymethacrylate PPD
(8) the remainder, a Group III base oil.

Testing

The lubricating oil compositions were evaluated in the Komatsu Hot Tube Test, the Engine Bench Test, and the Shell Four Ball Wear Test to assess their performance.

Komatsu Hot Tube Test

Detergency and thermal and oxidative stability are performance areas that are generally accepted in the industry as being essential to satisfactory overall performance of a lubricating oil. The Komatsu Hot Tube test is a lubrication industry bench test (JPI 5S-55-99) that measures the detergency and thermal and oxidative stability of a lubricating oil. During the test, a specified amount of test oil is pumped upwards through a glass tube that is placed inside an oven set at a certain temperature. Air is introduced in the oil stream before the oil enters the glass tube and flows upward with the oil. Evaluations of the lubricating oils were conducted at a temperature of 280° C. The test result is determined by comparing the amount of lacquer deposited on the glass test tube to a rating scale ranging from 1.0 (very black) to 10.0 (perfectly clean).

Shell Four Ball Wear Test

The wear preventative performance of each lubricating oil composition was determined in accordance with ASTM D4172 under conditions of 1800 rpm, oil temperature of 80° C. and load of 30 kg for periods of 30 minutes. After testing, the test balls were removed, the wear scars were measured, and the wear scar diameter shown as the result.

Engine Bench Test

Diesel engine test JASO (Japanese Automotive Standards Organization) detergency test: JASO M336-14): The weighted total demerit must not exceed 740 and no stuck rings are allowed. Diesel Engine Test (JASO valve train wear test: JASO M354-15): Evaluation of wear of the tappets.

The performance of lubricating oil compositions prepared in the Examples and Comparative Examples were tested using a water-cooled, 4-cylinder, 4-L diesel Hino N04C-VH making 120 kW at 2800 rpm. The engine is a direct injection turbocharged engine equipped with EGR. The exact procedure can be found at https://www.swri.org/sites/default/files/jaso-m336-m354-m362.pdf.

TABLE 2

| | Ref. Ex. 1 | Ex. 2 | Ex. 3 | Ex. 4 | Ex. 5 | Ex. 6 | Ex. 7 |
|---|---|---|---|---|---|---|---|
| Kinematic Viscosity (100° C.), $mm^2/s$ | 10.6 | 10.6 | 10.7 | 8.1 | 8.2 | 8.2 | 7.3 |
| Viscosity Index | 141 | 158 | 177 | 149 | 170 | 172 | 165 |
| CCS Viscosity, temperature ° C. | −25 | −30 | −35 | −30 | −35 | −35 | −35 |
| cP | <7000 | <6600 | <6200 | <6600 | <6200 | <6200 | <6200 |
| HTHS Viscosity (150° C.), cP | 3.2 | 3.2 | 3.2 | 2.7 | 2.7 | 2.7 | 2.4 |
| Ca, wt. % | 0.27 | 0.27 | 0.27 | 0.27 | 0.27 | 0.27 | 0.27 |
| Mg, wt. % | 0.0010 | 0.0010 | 0.0010 | 0.0010 | 0.0010 | 0.0010 | 0.0010 |
| P, wt. % | 0.040 | 0.040 | 0.040 | 0.040 | 0.040 | 0.020 | 0.040 |
| Zn, wt. % | 0.048 | 0.048 | 0.048 | 0.048 | 0.048 | 0.024 | 0.048 |
| S, wt. % | 0.12 | 0.12 | 0.12 | 0.12 | 0.12 | 0.078 | 0.12 |
| B, wt. % | 0.018 | 0.018 | 0.018 | 0.018 | 0.018 | 0.018 | 0.018 |
| Mo, wt. % | 0.016 | 0.016 | 0.016 | 0.016 | 0.016 | 0.016 | 0.016 |
| K, wt. % | 0.021 | 0.021 | 0.021 | 0.021 | 0.021 | 0 | 0.021 |
| N, wt. % | 0.069 | 0.069 | 0.069 | 0.069 | 0.069 | 0.069 | 0.069 |
| Sulfated Ash, wt. % | 1.07 | 1.07 | 1.07 | 1.07 | 1.07 | 1.04 | 1.07 |
| Komatsu Hot Tube Test | | | | | | | |
| Merit Rating | 10.0 | 10.0 | 10.0 | 9.5 | 10.0 | 10.0 | 10.0 |
| Shell 4 Ball Wear Test | | | | | | | |
| Wear Scar Diameter, mm | 0.44 | 0.42 | 0.40 | 0.41 | 0.39 | 0.41 | 0.38 |
| Engine Bench Test-JASO M336: 3014 (JASO M354: 2015) | | | | | | | |
| Weighted Total Demerit (WTD) 740 max | 531 | 487 | 466 | 440 | 644 | — | — |
| Stuck Rings (Y/N) | N | N | N | N | N | — | — |
| Tappet Wear 11.3 μm max | 8.8 | 10.6 | 10.1 | 9.7 | 9.8 | — | — |
| Carbone residue increase after test, 3.0% wt. min. | 5.8 | 3.7 | 4.7 | 4.0 | 4.8 | — | — |

TABLE 2-continued

| | Ex. 8 | Ex. 9 | Ex. 10 | Ex. 11 | Ex. 12 | Ex. 13 | Ex. 14 |
|---|---|---|---|---|---|---|---|
| Kinematic Viscosity (100° C.), $mm^2/s$ | 7.2 | 7.2 | 10.6 | 8.1 | 8.1 | 8.1 | 8.1 |
| Viscosity Index | 163 | 163 | 158 | 149 | 170 | 170 | 170 |
| CCS Viscosity temperature, ° C., | −35 | −35 | −30 | −30 | −35 | −35 | −35 |
| cP | <6200 | <6200 | <6600 | <6600 | <6200 | <6200 | <6200 |
| HTHS Viscosity (150° C.), cP | 2.4 | 2.4 | 3.2 | 3.2 | 2.7 | 2.7 | 2.7 |
| Ca, wt. % | 0.20 | 0.17 | 0.27 | 0.27 | 0.27 | 0.20 | 0.17 |
| Mg, wt. % | 0.0010 | 0.038 | 0.0010 | 0.0010 | 0.0010 | 0.0010 | 0.038 |
| P, wt. % | 0.040 | 0.040 | 0.020 | 0 | 0 | 0 | 0 |
| Zn, wt. % | 0.048 | 0.048 | 0.024 | 0 | 0 | 0 | 0 |
| S, wt. % | 0.11 | 0.11 | 0.078 | 0.038 | 0.038 | 0.030 | 0.034 |
| B, wt. % | 0.018 | 0.018 | 0.018 | 0.018 | 0.018 | 0.018 | 0.018 |
| Mo, wt. % | 0.016 | 0.016 | 0.016 | 0.016 | 0.016 | 0.016 | 0.016 |
| K, wt. % | 0.021 | 0.021 | 0.021 | 0.021 | 0.021 | 0.021 | 0.021 |
| N, wt. % | 0.069 | 0.069 | 0.069 | 0.069 | 0.069 | 0.069 | 0.069 |
| Sulfated Ash, wt. % | 0.80 | 0.81 | 1.04 | 0.93 | 0.93 | 0.08 | 0.81 |
| Komatsu Hot Tube Test | | | | | | | |
| Merit Rating | 10.0 | 10.0 | 10.0 | 7.0 | 7.0 | 10.0 | 10.0 |
| Shell 4 Ball Wear Test | | | | | | | |
| Wear Scar Diameter, mm | 0.42 | 0.42 | 0.41 | 0.41 | 0.32 | 0.37 | 0.45 |
| Engine Bench Test-JASO M336: 3014 (JASO M354: 2015) | | | | | | | |
| Weighted Total Demerit (WTD) 740 max | — | — | 417 | 375 | — | — | — |
| Stuck Rings (Y/N) | — | — | N | N | — | — | — |
| Tappet Wear 11.3 μm max | — | — | 8.5 | 6.7 | — | — | — |
| Carbone residue increase after test, 3.0% wt. min | — | — | 3.7 | 4.4 | — | — | — |

| | Comp. Ex. 1 | Comp. Ex. 2 | Comp. Ex. 3 | Comp. Ex. 4 | Comp. Ex. 5 | Comp. Ex. 6 |
|---|---|---|---|---|---|---|
| Kinematic Viscosity (100° C.), $mm^2/s$ | 7.2 | 7.2 | 7.2 | 10.5 | 10.5 | 10.5 |
| Viscosity Index | 163 | 163 | 163 | 158 | 157 | 157 |
| CCS Viscosity temperature, ° C., | −35 | −35 | −35 | −30 | −30 | −30 |
| cP | <6200 | <6200 | <6200 | <6600 | <6600 | <6600 |
| HTHS Viscosity (150° C.), cP | 2.4 | 2.4 | 2.4 | 3.2 | 3.2 | 3.2 |
| Ca, wt. % | 0.27 | 0.27 | 0.27 | 0.27 | 0.27 | 0.27 |
| Mg, wt. % | 0.0010 | 0.0010 | 0.0010 | 0.0010 | 0.0010 | 0.0010 |
| P, wt. % | 0.040 | 0.040 | 0.040 | 0 | 0 | 0 |
| Zn, wt. % | 0.048 | 0.048 | 0.048 | 0 | 0 | 0 |
| S, wt. % | 0.12 | 0.12 | 0.12 | 0.37 | 0.37 | 0.37 |
| B, wt. % | 0.0020 | 0.0020 | 0.018 | 0.0020 | 0.0020 | 0.018 |
| Mo, wt. % | 0 | 0.016 | 0 | 0 | 0.016 | 0 |
| K, wt. % | 0 | 0 | 0.021 | 0 | 0 | 0.021 |
| N, wt. % | 0.061 | 0.061 | 0.069 | 0.061 | 0.061 | 0.069 |
| Sulfated Ash, wt. % | 0.97 | 1.06 | 0.98 | 0.91 | 0.92 | 0.92 |
| Komatsu Hot Tube Test | | | | | | |
| Merit Rating | 10.0 | 10.0 | 10.0 | 3.0 | 4.0 | 4.0 |
| Shell 4 Ball Wear Test | | | | | | |
| Wear Scar Diameter, mm | 0.58 | 0.55 | 0.51 | 1.91 | 0.59 | 0.53 |
| JASO M336: 3014 (JASO M354: 2015) | | | | | | |
| Weighted Total Demerit (WTD) 740 max | — | — | — | — | — | — |
| Stuck Rings (Y/N) | — | — | — | — | — | — |
| Tappet Wear 11.3 μm max | — | — | — | — | — | — |
| Carbone residue increase after test, 3.0% wt. min | — | — | — | — | — | — |

As shown in Table 2, the lubricating oil compositions containing an organo-molybdenum compound and a dispersed hydrated alkali metal borate compound provide comparable or superior anti-wear properties and high temperature detergency and thermal stability to lubricating oil compositions containing conventional dispersant and alkaline earth metal detergent at very low viscosity grades, even if the phosphorus content is at a lower concentration or zero.

What is claimed is:

1. A lubricating oil composition having a HTHS viscosity at 150° C. in a range of about 1.7 to about 3.2 mPa s and a low temperature cold cranking viscosity of less than 7,000 mPa s at −20° C., comprising:

(a) a major amount of an oil of lubricating viscosity having a kinematic viscosity at 100° C. of from 3.5 $mm^2/s$ to 20 $mm^2/s$ and a viscosity index of greater than 120 with a sulfur content of less than 0.03 wt. %, are classified into the API group III, IV, or V base stock category, and have an aromatics content ($C_A$) of less than 5%;

(b) an organomolybdenum compound providing greater than 0.0050 wt. % of molybdenum to the lubricating oil composition;

(c) a dispersed hydrated alkali metal borate compound providing greater than 0.0050 to about 0.060 wt. % of alkali metal to the lubricating oil composition;

(d) a sulfur phosphorus anti-wear compound providing the lubricating oil composition with from 0 to about 0.06 wt. % of phosphorus;

(e) one or more dispersants providing the lubricating oil composition with greater than 0.0050 to about 0.040 wt. % of nitrogen; and (f) one or more calcium-based metal detergents selected from salicylate, sulfonate, and phenate;

(g) optionally, one or more magnesium-based metal detergents selected from salicylate, sulfonate, and phenate; and wherein the lubricating oil composition has a calcium content of from about 0.14 to about 0.30 wt. %, when present a magnesium content of from about 0.0005 to about 0.060 wt. %, a total nitrogen amount of from 0.0050 to about 0.090 wt. %, sulfur content of less than 0.13 wt. % and a sulfated ash level of from about 0.6 to about 1.1 wt. %.

2. The lubricating oil composition of claim 1, wherein the organomolybdenum compound provides from about 0.0050 to about 0.050 wt. % of molybdenum to the lubricating oil composition.

3. The lubricating oil composition of claim 1, wherein the dispersed hydrated alkali metal borate compound provides from about 0.0050 to about 0.10 wt. % of boron to the lubricating oil composition.

4. The lubricating oil composition of claim 1, wherein phosphorus is present from 0 to about 0.04 wt. % based on the total weight of lubricating oil composition.

5. The lubricating oil composition of claim 1, wherein phosphorus is present from 0 to about 0.03 wt. % based on the total weight of lubricating oil composition.

6. The lubricating oil composition of claim 1, wherein the lubricating oil composition is free of phosphorus.

7. The lubricating oil composition of claim 1, wherein sulfur is present from about 0.01 to about 0.4 wt. % based on the total weight of the lubricating oil composition.

8. The lubricating oil composition of claim 1, wherein sulfated ash is present from about 1.1 to about 0.6 wt. % based on the total weight of the lubricating oil composition.

9. The lubricating oil composition of claim 1, wherein the lubricating oil composition is a 0W-8, 0W-12, 0W-16, or 0W-20 SAE viscosity grade.

10. The lubricating oil composition of claim 1, wherein the lubricating oil composition has a HTHS viscosity at 150° C. in a range of about 2.0 to about 3.6 mPa s.

11. The lubricating oil composition of claim 1, wherein the lubricating oil composition has a kinematic viscosity at 100° C. of from 3.5 $mm^2/s$ to 12 $mm^2/s$.

12. The lubricating oil composition of claim 1, wherein the lubricating oil is selected from one or more of API Group III, IV, and V.

13. A method for improving wear, high temperature detergency, and thermal stability in an engine comprising operating said engine with a lubricating oil composition having a HTHS viscosity at 150° C. in a range of about 1.7 to about 3.2 mPa s and a low temperature cold cranking viscosity of less than 7,000 mPa s at −20° C., comprising:

(a) a major amount of an oil of lubricating viscosity having a kinematic viscosity at 100° C. of from 3.5 $mm^2/s$ to 20 $mm^2/s$ and a viscosity index of greater than 120 with a sulfur content of less than 0.03 wt. %, are classified into the API group III, IV, or V base stock category, and have an aromatics content ($C_A$) of less than 5%;

(b) an organomolybdenum compound providing greater than 0.0050 wt. % of molybdenum to the lubricating oil composition;

(c) a dispersed hydrated alkali metal borate compound providing greater than 0.0050 to about 0.060 wt. % of alkali metal to the lubricating oil composition;

(d) a sulfur phosphorus anti-wear compound providing the lubricating oil composition with from 0 to about 0.06 wt. % of phosphorus;

(e) one or more dispersants providing the lubricating oil composition with greater than 0.005 to about 0.040 wt. % of nitrogen; and (f) one or more calcium-based metal detergents selected from salicylate, sulfonate, and phenate;

(g) optionally, one or more magnesium-based metal detergents selected from salicylate, sulfonate, and phenate; and wherein the lubricating oil composition has a calcium content of from about 0.14 to about 0.30 wt. %, when present a magnesium content of from about 0.0005 to about 0.060 wt. %, a total nitrogen amount of from 0.0050 to about 0.090 wt. %, sulfur content of less than 0.13 wt. % and a sulfated ash level of from about 0.6 to about 1.1 wt. %.

14. The method of claim 13, wherein the organomolybdenum compound provides from about 0.0050 to about 0.050% wt of molybdenum to the lubricating oil composition.

15. The method of claim 13, wherein the dispersed hydrated alkali metal borate compound provides from about 0.0050 to about 0.10 wt. % of boron to the lubricating oil composition.

16. The method of claim 13, wherein phosphorus is present from 0 to about 0.04 wt. % based on the total weight of lubricating oil composition.

17. The method of claim 13, wherein phosphorus is present from 0 to about 0.03 wt. % based on the total weight of lubricating oil composition.

18. The method of claim 13, wherein the lubricating oil composition is free of phosphorus.

19. The method of claim 13, wherein sulfur is present from about 0.01 to about 0.4 wt. % based on the total weight of the lubricating oil composition.

20. The method of claim 13, wherein sulfated ash is present from about 1.1 to about 0.6 wt. % based on the total weight of the lubricating oil composition.

21. The method of claim 13, wherein the lubricating oil composition is a 0W-8, 0W-12, 0W-16, or 0W-20 SAE viscosity grade.

22. The method of claim 13, wherein the lubricating oil composition has a HTHS viscosity at 150° C. in a range of about 2.0 to about 3.6 mPa s.

23. The method of claim 13, wherein the lubricating oil composition has a kinematic viscosity at 100° C. of from 3.5 $mm^2/s$ to 12 $mm^2/s$.

24. The method of claim 13, wherein the lubricating oil is selected from one or more of API Group III, IV, and V.

* * * * *